United States Patent [19]

Curtis

[11] 4,006,937

[45] Feb. 8, 1977

[54] CARRIAGE ESPECIALLY FOR USE IN MINES

[75] Inventor: Brian Matthew Curtis, Scarcliffe, England

[73] Assignee: Perard Engineering Ltd., England

[22] Filed: Jan. 31, 1975

[21] Appl. No.: 546,041

[30] Foreign Application Priority Data

Feb. 2, 1974 United Kingdom ..... 4927/74

[52] U.S. Cl. ..... 299/43; 74/422; 105/29 R

[51] Int. Cl.[2] ..... E21C 29/04

[58] Field of Search ..... 74/422; 299/34, 33; 105/29 R

[56] References Cited

UNITED STATES PATENTS

| | | | |
|---|---|---|---|
| 3,171,363 | 3/1965 | Eden et al. | 105/29 R |
| 3,399,578 | 9/1968 | Lindabury, Sr. et al. | 74/422 X |
| 3,718,368 | 2/1973 | Rassmann et al. | 299/34 |
| 3,824,871 | 7/1974 | Loesch et al. | 74/422 |
| 3,879,088 | 4/1975 | Sodder et al. | 61/45 D |

*Primary Examiner*—Ernest R. Purser
*Assistant Examiner*—William F. Pate, III
*Attorney, Agent, or Firm*—William Anthony Drucker

[57] ABSTRACT

A carriage and drive mechanism for use in mines in which the drive engages a continuous chain and moves the carriage along a rack; including a chain deflecting device and chain guide members.

7 Claims, 6 Drawing Figures

CARRIAGE ESPECIALLY FOR USE IN MINES

This invention relates to a carriage, especially for use in mines, for example, a mineral winning machine for cutting coal in a coal mine, or for use with other minerals.

It has previously been proposed to provide carriages which are self-propelled by means of a continuous chain or track. Such proposals have used roller type chains usually driven by conventional sprockets and comprising two row of side arms, each arm being pivotally articulated with respect to the next arm in one plane, with rollers between the side arms defining apertures between the rollers in which engage the pins of the rack. Use of such carriages in mines has been contemplated, but there are many problems.

At a coal face, it is usual to provide a conveyor to take off coal as it is cut. The conveyor is made up of articulated sections, which are progressively advanced as the coal face recedes. The conveyor, therefore, snakes horizontally and also vertically in view of uneven ground and the sections can telescope. The coal winning machine rides on the conveyor. To provide sufficient traction, it is necessary to provide a rack for the chain to engage. A roller chain has lateral rigidity and there are, therefore, problems in the chain following a rack which must snake and telescope similarly to the conveyor and therefore must be made of similar sections. Furthermore, the pitch of the teeth of the rack must be constant across the joins in the sections of the rack, where even slight telescoping can upset the pitch sufficiently to prevent engagement of the chain with the rack teeth. Also, it is difficult to provide robust teeth, since an increase in their size means that the size of the chain must be similarly increased and robustness is clearly essential in a mine, where massive machinery is used. In addition, roller chains are expensive and liable to break in mining conditions.

From one aspect, the present invention provides a carriage adapted for running along a rack, the carriage having a drive mechanism for mounting and driving a continuous chain engageable with a rack for driving the carriage along the rack, the drive mechanism comprising drive means adapted for engagement with a continuous link chain having adjacent links in relatively perpendicular planes by provision of teeth which engage the outer perimeters of the links, a pair of guide members for the chain and spaced lengthwise of the carriage, and deflection means between the guide members of said pair serving, in use, to deflect a continuous link chain, engaged with the guide members and the drive means, along a path deflected out of the direct path between the guide members to engage the rack.

The invention also resides in a mineral face conveyor comprising spaced generally parallel rails along which a mineral winning machine may be slidably moved, and a rack having a plurality of teeth spaced lengthwise of the conveyor and adapted for engagement with the perimeters of the links of a link chain.

The invention also resides in a mineral winning installation comprising a mineral winning machine having a carriage as defined above, together with a mineral face conveyor as defined above whereby the portion of a chain deflected by the deflection means is engaged with the rack so that rotation of the chain by the drive sprocket drives the machine along the conveyor.

The invention also resides in a spill plate arrangement comprising a support, adapted for mounting on a mineral face conveyor, a spill plate mounted on the support and a rack carried by the support, the rack having a plurality of teeth, spaced lengthwise of the conveyor with the support attached thereto, the teeth being adapted to engage the perimeters of the links of a link chain.

With this arrangment, the chain is very robust to meet the conditions in a coal mine, and is much less likely to break than a roller chain. Also the chain is sufficiently flexible readily to follow the horizontal snaking of the conveyor and to allow for some variations in the pitch of the teeth due to telescoping of rack sections. The teeth can be made very robust, and massive as compared with roller-chain pins, since the chain links engage the outside portions of the chain. Furthermore, the spill plates used can be conventional. No special spill plates of complex construction need to be manufactured and furthermore, the conveyor can be a conventional conveyor which is readily adapted by mounting of the rack thereon.

It is envisaged that in addition to use in a mineral winning machine, the carriage according to the invention may be used for carrying equipment such as drills and may be used for transport of people and materials, not only in mines. The invention is particularly useful where inclines have to be negotiated.

Although it is preferred that the spill plate arrangement is used, so that the rack is on the goaf side, it is contemplated that the rack may be on the face side of the conveyor.

It is also preferred that the chain is downwardly deflected to engage upward facing teeth, but horizontally projecting teeth, engaged by a horizontally deflecting chain may be utilised.

Preferably, the deflecting means is in the form of a shoe adapted to engage both opposite sides of the chain to locate the chain laterally. This feature provides a compact way of deflecting the chain and simultaneously of preventing undue lateral motion of the chain to ensure positive engagement with the rack.

Advantageously, the shoe is flexibly mounted for angular horizontal movement. This feature permits sufficient lateral twisting movement of the chain to ensure that the chain follows the bends in the snaking conveyor.

The shoe preferably is adapted at any moment to support a plurality of links of the chain in a common horizontal plane at the position of maximum downward deflection. This means that a plurality of the links simultaneously engage the rack, providing very firm traction. With this arrangement, some of the teeth could be omitted, for example, at the joints of the sections of the rack.

The shoe is preferably provided with a plough member for cleaning the rack as the machine moves therealong. In a coal mine there is always a problem of debris clogging mechanical parts and a large quantity of debris is liable to build up on the rack, eventually completely clogging it. This feature provides a very simple way of keeping the rack relatively clean by pushing the debris away as the machine moves forward. Preferably, each tooth of the rack is composed of two spaced projections, the vertical links of the chain engaging in the space therebetween. With this arrangement, the plough passes along a path extending through these spaces. This is a very simple, cheap and effective arrangement.

The drive means is preferably a sprocket and other guide sprockets may be provided. All the sprockets may be co-planar, particularly vertically arranged, for use with deep seams.

The drive sprocket is, however, preferably horizontal and two pairs of vertical sprockets are provided for leading the chain to and from the drive sprocket, respectively, the chain passing between the sprockets of each pair. This arrangement is particularly compact, for shallow seams, the comparatively large drive sprocket being arranged within the width of the machine and taking up little space vertically. With a roller chain, all the sprockets would have to be vertically oriented, with this arrangement restricting its use to deep seams. Horizontal location of all the drive sprockets is possible with a roller chain, but this would require the provision of special spill plate arrangements since it is necessary to provide a lateral guide for the winning machine to hold the chain in engagement with the rack. Also this arrangement introduces limitations affecting the prop free front between the coal face and and the roof supports.

Reference is now made to the accompanying drawings, wherein.

Figure 1:
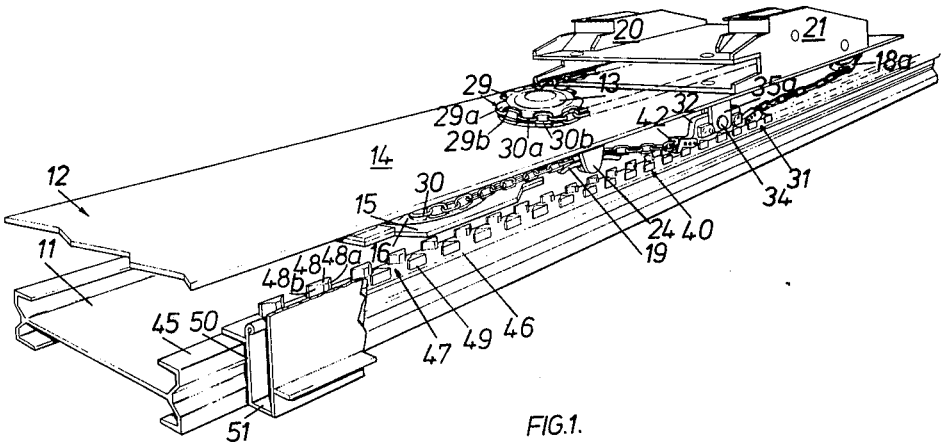
FIG. 1 is a perspective side view of a mineral winning to installation showing a winning machine mounted on an armoured face conveyor provided with a rack.
Figure 2:
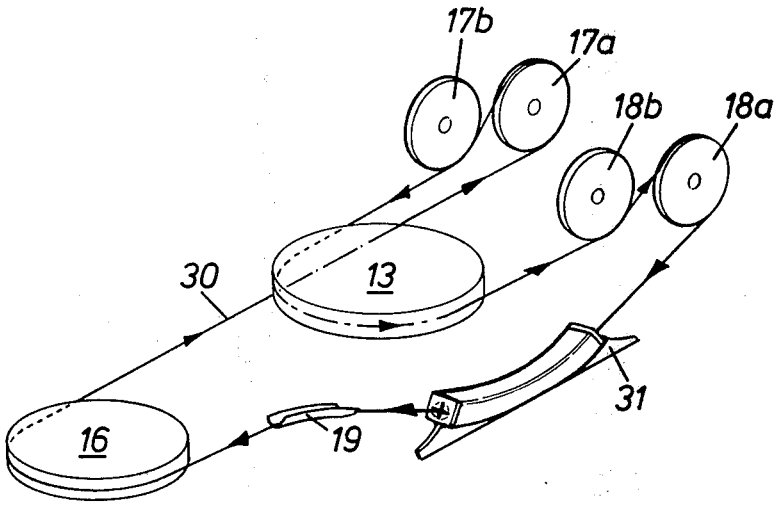
FIG. 2 is a diagrammatic view showing the path of a continuous drive chain through the machine of FIG. 1.

Referring to the drawings, the installation shown comprises an armoured face conveyor 11 and a winning machine frame 12. In use, the frame mounts a cutting head (not shown) in conventional manner. The frame 12 mounts a horizontal drive sprocket 13 rotatable about a vertical axis and located above a main plate 14 of the frame. A horizontal idler sprocket 16 is provided, spaced along the frame from the drive sprocket. This idler sprocket is mounted below the main plate 14 and above a lower plate 15. Vertical idler sprockets are also provided spaced from the drive sprocket in the opposite direction along the frame. These sprockets are carried in housings 20, 21 at opposite sides of the machine. Each housing contains a pair of the vertical sprockets, which are illustrated in FIG. 2, a first pair including the sprockets labelled 17*a*, 17*b* and the second pair including the sprockets labelled 18*a*, 18*b*. Part of one of the sprockets, 18*a*, is visible in FIG. 1. The second pair of sprockets 17*a*, 17*b* serves to change the direction of a continuous chain 30 as it passes from the drive sprocket 13, so that the chain is directed in a vertical plane to engage with a shoe 31. The chain passes from the shoe to a guide 19 which directs the chain to the horizontal idler sprocket 16. From this sprocket, the chain runs to the first pair of idler sprockets 17*a*, 17*b* serving to raise the chain and direct it back to the drive sprocket 13.

The chain 30 is a link chain composed of a multiplicity of links engaged end to end and alternately relatively offset by 90°. Each sprocket is adapted to engage the peripheries of the links of the chain, each link being generally oval. As apparent from the drive sprocket 13 as shown in FIG. 1, each sprocket has a multiplicity of teeth 29 spaced around the sprocket, with each tooth comprising two projections 29*a*, 29*b*, spaced radially of the sprocket. The arrangement is such that whilst one link 30*a* is engaged between each two projections, these links lying in a plane containing the sprocket axis, each adjacent link 30*b*, which is relatively perpendicular, lies between a pair of the teeth 29, the teeth being shaped to engage a portion of the link at each corner. Such sprockets are well known and have been used in coal mines for hauling a machine along a fixed chain.

The guide 19 is a member having a convexly curved guide surface bounded by side walls, i.e. is in the form of an arcuately shaped channel. The guide is carried between a pair of lugs 24.

Figure 4:
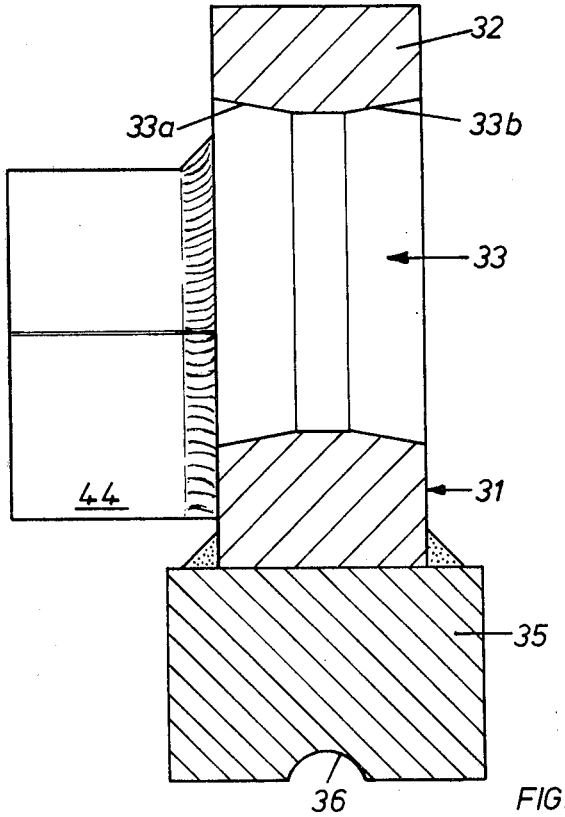
FIG. 4 is a sectional view on the line 4—4 of FIG. 3.
Figure 3:
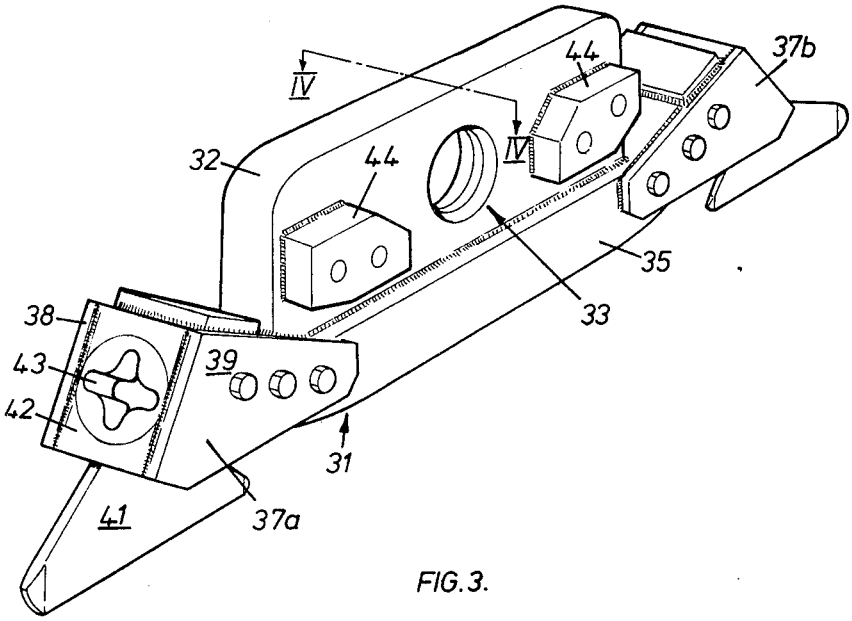
FIG. 3 is a perspective view of a chain guide shoe of the machine.

The shoe 31 is mounted between the guide 19 and the sprocket 18*a* and serves to deflect the chain 30 downwardly from these chain guide members into engagement with a rack 40. The shoe has a body portion 32 (FIG. 3) provided with an aperture 33, which receives a shaft 34 (FIG. 1). The shaft is carried horizontally between a pair of lugs 35*a* on the frame 12 and the shoe body portion 32 extends between the lugs and is movable in a vertical plane about the shaft. The shoe is also capable of some pivotal flexing movement in a horizontal plane and this is provided by shaping of the defining wall of the aperture 33. As shown in FIG. 4, the aperture increases in diameter outwardly from the axial centre of the aperture in both opposite directions, defining frusto-conical portions 33*a*, 33*b*, of the defining wall. This arrangement permits limited horizontal movement of the shoe.

The body is welded to a chain-engaging member 35 provided with an elongate groove 36. This groove is shaped to locate a side of a link of the chain 30. At each end of the body is mounted a respective chain locating device 37*a*, 37*b*. Each of these devices comprises a pair of side plates 38, 39 with a guide plate 42 welded between them. The guide plate has a cruciform aperture 43 shaped to receive and locate both horizontally extending links and vertically extending links of the chain 30.

Each chain locating deivce 37*a*, 37*b* also mounts, below the guide plate 42, a plough member 41.

The body 32 has bosses 44 for a purpose to be described.

The rack 40 is provided along the top of one side rail 45 of the conveyor 11, at the goaf side, the rack comprising a plate 46 provided with teeth 47. Each tooth comprises two projections 48, 49 spaced laterally of the plate 46. Each projection has two concave surfaces, such as 48*a*, 48*b* arranged so that the four projections of each pair of adjacent teeth 47 have concave surfaces which engage respective peripheral curved corners of a horizontal link of the chain.

Figure 5:
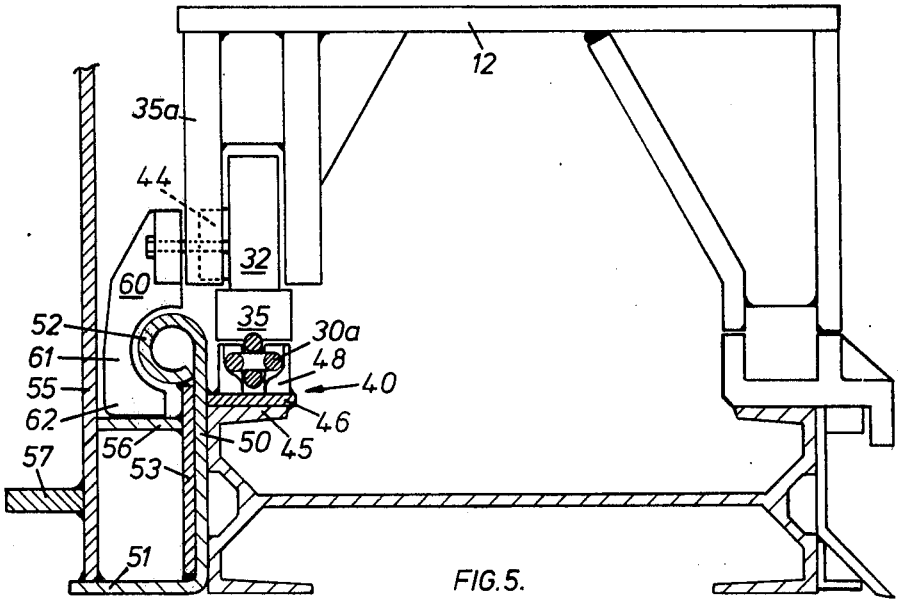
FIG. 5 is a diagrammatic sectional part veiw of the installation of FIG. 1.

The rack plate 46 ia fixed to a side plate 50 in turn fixed to the conveyor (see FIGS. 1 and 5). The side plate 50 is integral with a base plate 51, extending away from the conveyor 11. The top of the side plate 50 projects above the conveyor to above the level of the top of the rack 40 and is rolled to define a cylindrical rail 52. This rail is reinforced by a vertical support plate 53 welded thereto and to the base plate 51. A spill plate 55 is also welded to the base plate 51 and a platform 56 also extends between the spill plate 55 and the support plate 53. The spill plate has a conventional clevis rail 57 for attachment to a self-advanceable roof support.

A guide member 60 is mounted on the bosses 44 of the guide shoe 31 and this member has a downwardly extending curved arm 61 provided with a head 62. The curve is concave and substantially complementary to the curve of the rail 52.

In operation, the drive sprocket 13 is rotatably driven, so that the chain 30 continuously moves along the path illustrated in FIG. 2. The chain passes through the guide plate 42 on the guide shoe 31 and the vertical links within the shoe engage with the groove 36, the shoe deflects the chain downwardly and the vertical links engaged with the groove 36 are held down between the projections of each tooth 47 whilst the alternate horizontal links are peripherally engaged by the curved faces, such as 48*a*, 48*b*, of the teeth. Three such horizontal links are simultaneously engaged with the teeth. Because of this engagement, the machine frame 11 is caused to move along the conveyor.

As the machine frame moves along the conveyor, the leading plough member 41 moves along the rack passing between the projections of each tooth 47. This action serves to clean the rack just before engagement by the chain, there being a considerable accumulation of dust and pieces of coal in practice. The guide member 60 holds the shoe down during such movement and prevents the plough member from riding too high over accumulated coal on the rack.

The conveyor 11 is made up of sections joined end to end and relatively articulatable, so that the conveyor snakes both horizontally and vertically on uneven ground. The shoe is capable of flexing both horizontally and vertically about the shaft 34 to follow the snaking path and the link chain can also similarly flex.

It will be appreciated that the plough members 41 or equivalent members may be mounted elsewhere on the frame 12, other than on the guide shoe 31. Also, it may be possible to replace one or more of the idler sprockets with guide members such as the guide 19, or the guide 19 may be replaced by a sprocket.

A tensioning device may be incorporated for tensioning the chain.

The rack is made up of sections, each of which corresponds to a section of the conveyor 11, the conveyor being, in conventional manner, made up of sections joined together, so as to permit vertical and horizontal articulation and telescoping. Each rack section forms a part of a spill plate arrangement, as illustrated by the components 40, 50, 51, 53, 55 and 56 in FIG. 5. The side plate, or support 50 of the arrangement is bolted to a corresponding section of the conveyor.

Figure 6:
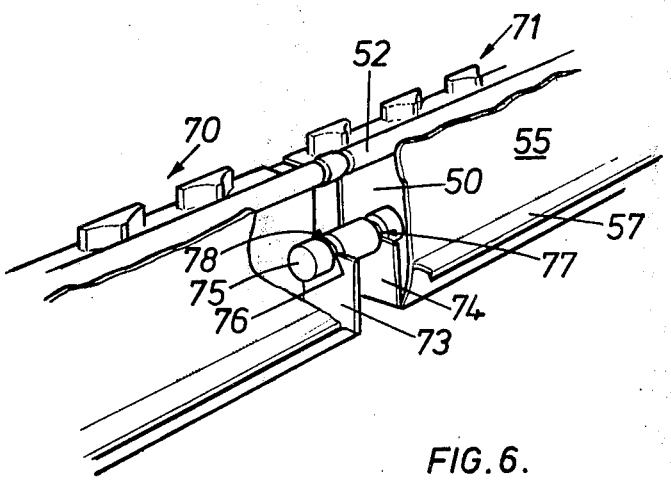
FIG. 6 is a perspective view of a part of the installation.

FIG. 6 shows the join between two spill plate arrangements, numbered 70, 71 respectively. Between the side plate 50 and the spill plate 55 of each arrangement is fixed a respective vertical plate 73, 74. Each plate has a semi-circular recess, as at 76, in its top. A cylindrical connector 75 is provided with two spaced annular grooves 77, 78 and each groove receives the marginal edge of a respective one of the recesses in the plates 73, 74, the neck defined by each groove being substantially complementary to the corresponding recess and seating therein. The groove is sufficiently wide to provide a loose connection between the two arrangements 70, 71, permitting limited relative movement with accompanying limited telescoping of the conveyor sections. This movement is sufficient to permit the required relative articulation of the conveyor sections, but not sufficient to alter the pitch of the teeth to a degree which is too great to be overcome by the inherent flexibility of the link chain.

What is claimed is:

1. A frame for a mineral winning machine, the frame having a drive mechanism for mounting and driving a continuous chain engageable with a rack for driving the machine along the rack, the drive mechanism comprising drive means mounted for rotation about a vertical axis, the drive means being adapted for engagement with a continuous link chain having adjacent links in relatively perpendicular planes by provision of teeth which engage the outer perimeters of the links, guide members for the chain and arranged so as to deflect the chain perpendicularly to the plane of the drive sprocket, a pair of the guide members being spaced lengthwise of the frame, and deflection means between the guide members of the pair and arranged to deflect the chain downwardly below the guide members to engage the rack.

2. A mineral winning installation comprising a mineral winning machine having a carriage or frame according to claim 1, and a mineral face conveyor on which the frame is slidably mounted. the conveyor being provided with a rack with which the portion of a chain deflected by the deflection means is engaged whereby rotation of the chain by the drive sprocket drives the machine along the conveyor.

3. A mineral face conveyor comprising spaced generally parallel rails along which a mineral winning machine may be slidably moved, and a rack secured to the rails having a plurality of teeth spaced lengthwise of the conveyor an interlocking round link chain on the machine, each two consecutive teeth together defining arcuate walls which engage, with each arcuate corner of a round link of a link chain, each tooth having an aperture which, receives the relatively perpendicular link adjacent the link engaged with said arcuate walls.

4. A mineral face conveyor according to claim 3, wherein each tooth is defined by two spaced projections.

5. A carriage adapted for movement along a rack, the carriage having a drive mechanism including a continuous chain engageable with a rack for driving the carriage along the rack, the chain being a link chain having adjacent links interlocked in relatively perpendicular planes, the drive mechanism comprising teeth on the rack which engage the outer perimeters of the links of the chain, a pair of guide members for the chain and spaced lengthwise of the carriage and deflection means between the guide members of said pair serving, in use, to deflect the continuous link chain along a path deflected out of the direct path between the guide members in order to engage the teeth on the rack, the carriage including a plough member driven by the carriage in alignment with the deflected path of the chain so as to run between the rack teeth prior to engagement of the chain therewith to clean the rack.

6. A mineral winning installation comprising a mineral winning machine and a mineral face conveyor on which said machine is slidably mounted, said conveyor being provided with a rack, said machine including a continuous chain engageable with the rack to drive said machine along the rack, the chain being a link chain having adjacent links interlocked in relatively perpendicular planes, a pair of guide members for the chain and spaced lengthwise of said machine, and deflection means between the guide members of said pair serving, in use, to deflect said chain along a path deflected out of the direct path between said members in order to engage the rack, said machine including a plough member, the rack comprising a plurality of spaced teeth wherein each tooth is defined by two spaced projections, each two consecutive teeth being adapted to engage with the outer perimeter of a horizontal link of the chain, with the adjacent vertical links engaged in the gaps between the projections of each tooth, the plough member being arranged to run along the rack through said gaps to clean the rack.

7. A spill plate arrangement comprising a support adapted for mounting on a mineral face conveyor, a spill plate mounted on the support and a rack carried by the support, the rack having a plurality of teeth spaced lengthwise of the conveyor with the support attached thereto and being adapted to engage an interlocking link chain forming part of the driving means of a carriage, said chain having adjacent round links in relatively perpendicular planes, two consecutive teeth together defining arcuate walls which engage each arcuate corner of a link, each tooth having an aperture which receives an adjacent relatively perpendicular link, the arrangement including an attachment element, and a connector adapted for connection to said attachment element and for connection to a further attachment element of another spill plate arrangement, so as to connect the arrangement together end-to-end permitting limited relative movement between the arrangements.

* * * * *